US006464036B1

(12) United States Patent
Yenner et al.

(10) Patent No.: US 6,464,036 B1
(45) Date of Patent: Oct. 15, 2002

(54) AIR INTAKE SILENCER

(75) Inventors: Daniel Lloyd Yenner, Raleigh, NC (US); David Lawrence Phillips, Horicon, WI (US)

(73) Assignee: Deere & Company, Moline, IL (US)

( * ) Notice: Subject to any disclaimer, the term of this patent is extended or adjusted under 35 U.S.C. 154(b) by 62 days.

(21) Appl. No.: 09/659,838

(22) Filed: Sep. 11, 2000

(51) Int. Cl.[7] ..... G10C 3/26
(52) U.S. Cl. ..... 181/229; 181/228
(58) Field of Search ..... 181/228, 229, 181/211, 212, 210, 238

(56) References Cited

U.S. PATENT DOCUMENTS

| | | | | |
|---|---|---|---|---|
| 3,966,014 A | | 6/1976 | Gowing | 181/35 A |
| 4,109,751 A | | 8/1978 | Kabele | 181/247 |
| RE30,306 E | | 6/1980 | Moore et al. | 181/229 |
| 4,757,874 A | * | 7/1988 | Yanagishita et al. | 181/229 |
| 5,962,820 A | * | 10/1999 | LePoutre | 181/229 |

* cited by examiner

*Primary Examiner*—Robert E. Nappi
*Assistant Examiner*—Kim Lockett

(57) ABSTRACT

A device for reducing sound emitted by the air intake of a internal combustion engine is provided. The device includes a dampening chamber formed of a one piece construction by rotational molding. Included as part of this mold are two tubular pipe-like sections designating both an inlet and an outlet whereby air is directed into the engine through the inlet and sound emitted by the engine is dampened as it enters the outlet of the silencer. The inlet and outlet are each formed within a pocket constructed in the mold that assists in creating the flow path for air as it moves throughout the chamber. The arrangement of the inlet and outlet in relation to one another assists in defining the sound reduction capability of the instant design and construction.

39 Claims, 3 Drawing Sheets

AIR INTAKE SILENCER

BACKGROUND OF THE INVENTION

1. Field of the Invention

The present invention relates to devices intended to reduce unwanted sounds created by internal combustion engines, and more specifically, to structure for decreasing the amount and intensity of sound produced by the air intake of such engines.

2. Description of Related Art

Throughout the world, governments concerned with the spread of noise pollution have enacted or are considering enacting legislation and/or regulations aimed at lessening the amount and effect(s) of that pollution. Those efforts are, in part, directed at limiting sound energy emissions provided by internal combustion engines utilized in both small and large scale vehicles, including emissions produced by grounds-care equipment. To address the restraints imposed by this legislation on permitted emissions levels, industry has sought to reduce the level of noise associated with both the exhaust and air induction systems of these engines.

With regard to the air induction system of internal combustion engines, devices known as air intake silencers have often been used to muffle, and therefore reduce, the noticeability of sound energy caused by these engines. With air as the medium through which sound travels, silencers of this type assist in reducing sound energy created when air is introduced into the engine from the atmosphere. This is in opposition to exhaust systems whereby sound is produced as air exits the engine. This energy often takes the form of noise, the loudness of that noise corresponding to the chosen engine speed upon entry of air into the silencer.

The design of intake silencers has included structure composed of several components requiring connection by welding or other means. For example, one construction includes an open dampening shell having covers welded thereon at its ends. Thereafter, inlet and outlet piping is then attached, by additional welds, to the periphery of apertures provided in the covers for accommodating the flow of air through the shell. Although designs of this type have been capable of performing a silencing function, materials and construction costs remain as areas in which improvement can be viewed as advantageous.

SUMMARY OF THE INVENTION

Thus, in order to obtain an economically advantageous construction, there is provided a silencer formed as a one-piece structure. This structure is formed according to the principles of rotational molding thereby reducing the expense of fabrication. Preferably, the mold will be constructed of plastic in the form of cross-linked polyethelene. Alternatively, composite materials could be substituted.

To permit air flow into an engine of vehicle, the silencer is constructed of a main body equipped with an inlet to which suitably fitting tubing can be attached to direct air into the inlet. Paralleling the inlet on an opposing side of the silencer is an outlet through which air is delivered to the engine. Those of ordinary skill in the art will recognize that designation of the inlet and outlet may be interchanged.

Forming the above inlet and outlet are two pipe-like formations molded as part of the overall silencer body. These formations are laterally spaced apart from one another and are substantially similar in the preferred embodiment. Formation of each of the inlet and outlet pipes in this manner enables the main body to be formed from a single mold while also creating an air flow path through the main body. Optimum silencing effect may be achieved by tailoring the dimensions and thus, the volume, of the main body to the engine with which the silencer is to be used. Such tailoring will permit an adequate and appropriately sized flow path so that as air is introduced into the engine during operation, the engine is not starved of air, thereby avoiding engine stall. It is contemplated that the silencer of the instant invention may be used with an engine equipped with either a carburetor or injector fuel delivery system.

Further delivery of air to the engine is accomplished by travel through additional tubing connected to the outlet and to an attached air filter flowing to the engine.

Thus, there is provided a simple and economical air intake silencer allowing for the introduction of air into a vehicle engine while silencing the effect of that entry.

DESCRIPTION OF THE PREFERRED EMBODIMENTS

Figure 2:
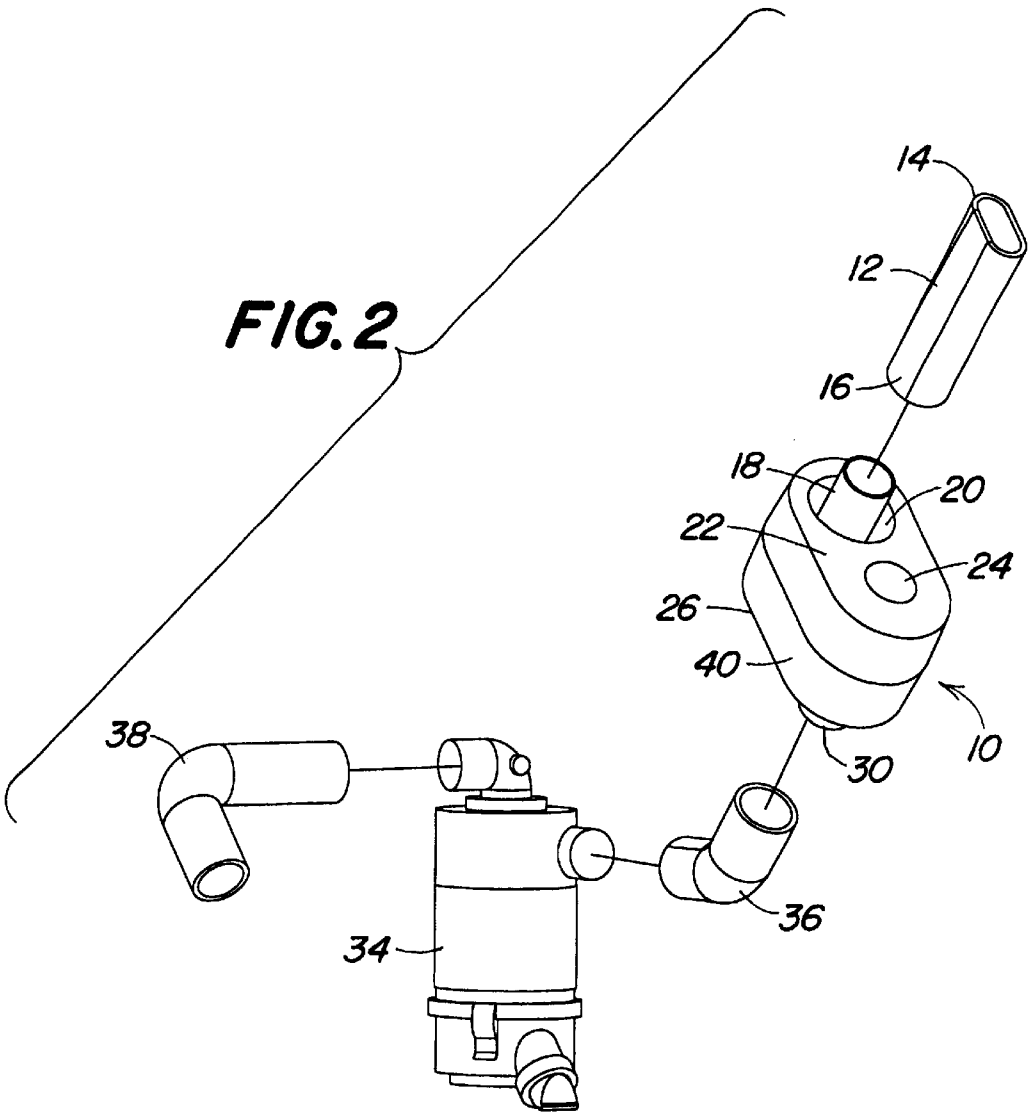
FIG. 2 is an exploded view corresponding to the illustration of FIG. 1.
Figure 1:
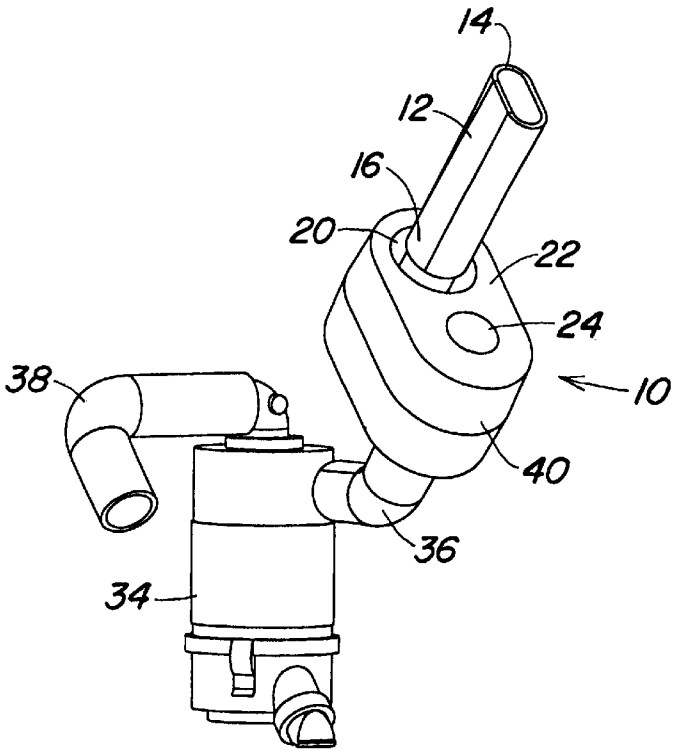
FIG. 1 is a front perspective view of the silencer of the present invention connected with an air filter.
Figure 3:
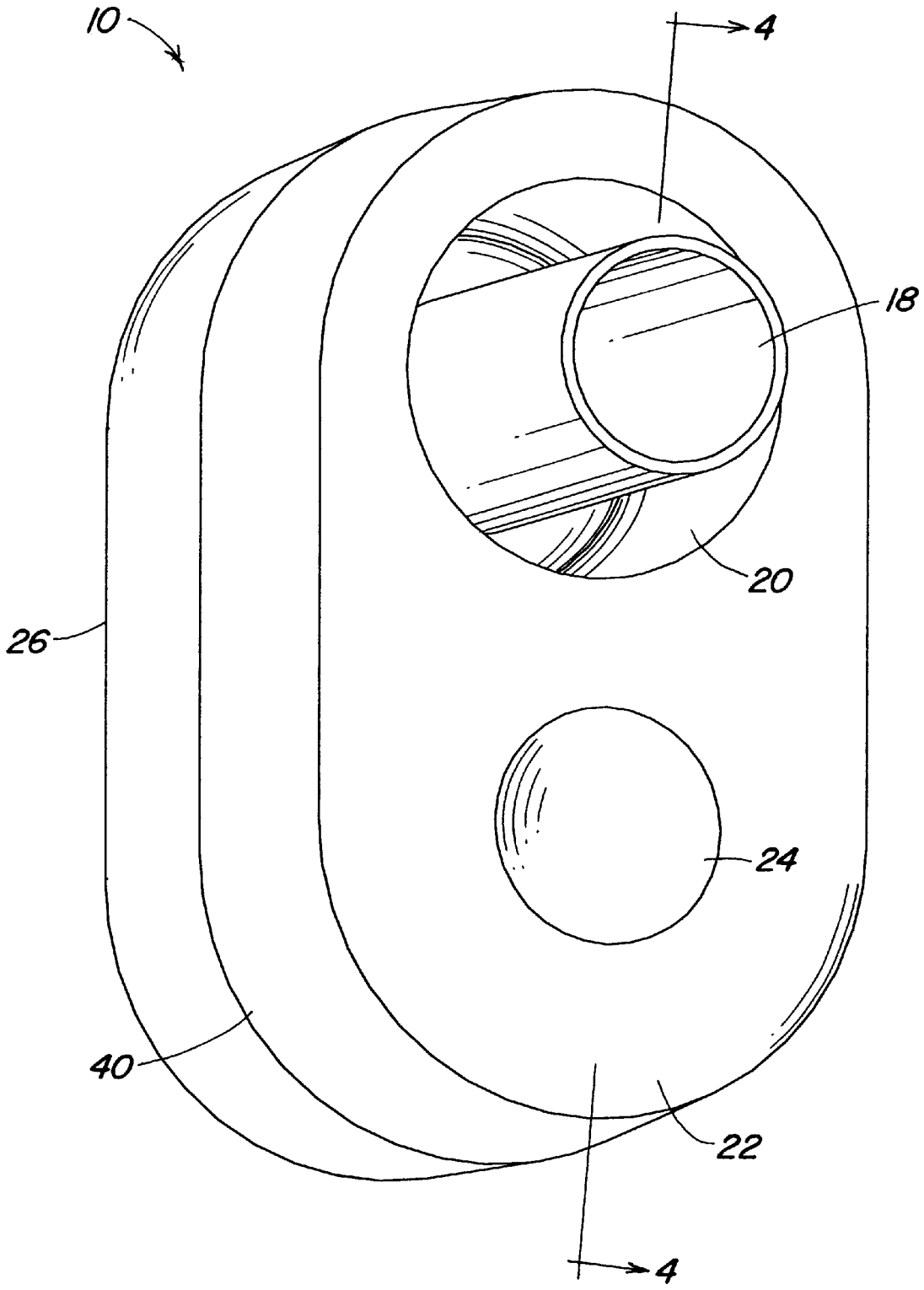
FIG. 3 is a top perspective view of the silencer according to the present invention and illustrating the inlet of the silencer.

Looking at FIGS. 1–2, there is illustrated the silencer 10 of the instant invention which may be arranged within and connected with an internal combustion engine (not shown). Further, it can be seen that air is to be directed into the silencer body 10 through a length of tubing 12 having, preferably, a tapered end 14 and a rounded end 16. Connected with the rounded end 16 is an inlet pipe 18 of silencer 10 set within a pocket 20 extending downwardly from a top surface 22, as best seen in FIG. 3. Spaced from inlet 18 is a first concave surface 24 formed within top surface 22. This concave 24 provides structural rigidity to silencer 10. On a bottom surface 26 is formed a pocket 28, and an outlet pipe 30, formed within the pocket 28 which is similar to pocket 20, through which air travels toward the engine. With like appearance as to top surface 22, a second concave surface 32, shown in FIG. 4, is formed across from outlet 30 on bottom surface 26.

Returning to FIGS. 1–2, it will be seen that silencer 10 is connected to an air filter 34 by a tubular elbow 36 at outlet 30. As air travels through filter 36, it is then directed toward engine 12 by an intake pipe 38.

Figure 4:
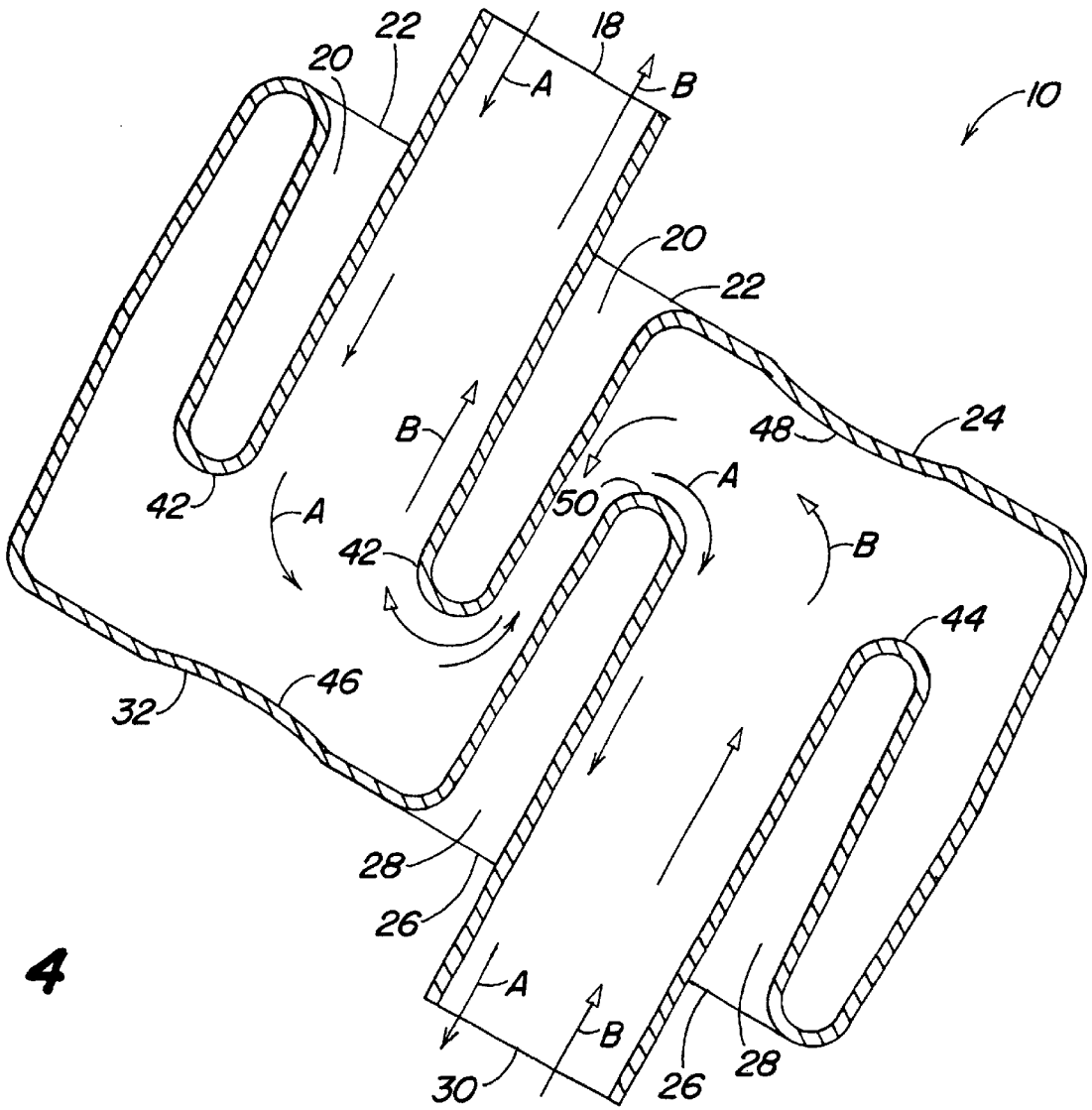
FIG. 4 is a cross-sectional view taken along lines 4—4 of FIG. 3 illustrating an outline of the silencer.

Shown in FIG. 4 is a cutaway view of silencer 10 taken along lines 4—4 of FIG. 3. This view illustrates the interior flow path and silencer structure relative to a generally cylindrical side surface 40. As can be seen, the inlet 18 and outlet 30 take the form of generally cylindrical tubes having therein respective end portions within the silencer overlapping one another. Accordingly, an interior end portion 42 of inlet 18 is located close to bottom surface 26 while an end portion 44 of outlet 30 is located closer to top surface 22. Together with pockets 20 and 28, parallel extension of inlet 18 and outlet 30 relative to each other in this manner serves to define an air path depicted by the directional arrows A provided in FIG. 4.

Flow of air through the silencer 10 is as follows. Air is first introduced into the engine (not shown) during its operation through tubing 12 wherein it then flows into silencer 10 via inlet 18. Upon movement beyond inlet 18, the stream of air is then smoothed upon encountering convex surfaces or deflectors 46, 48 which are opposite concave surfaces 32 and 24, respectively, on an interior of the silencer 10. After impacting deflector 46, the stream is then caused to flow through a channel 50 for delivery into outlet 30, where it then exits the silencer 10 and proceeds toward the engine.

Reduction of sound energy, in the form of noise resulting from the engine's operation, is attributable to at least two factors. First, silencer 10 is a reactive type silencer wherein a portion of sound produced by the engine enters the silencer 10 and is then reflected back towards the engine. This reflection back is caused, significantly, by the structural mold of the interior of the silencer 10. Accordingly, a large portion of sound does not radiate outwardly away from the engine toward the atmosphere. Secondly, sound traveling through the interior of the silencer 10, and outwardly toward the atmosphere, as shown by the directional arrows B in FIG. 4, is dampened in terms of its acoustic intensity. This dampening, as well as the reflection back mentioned above, is caused by the indirect path created by the convergence of inlet 18 and outlet 30 at channel 50 and shown by the arrows B in FIG. 4, in which sound must travel as it leaves the silencer 10. Travel along this path B provides an opportunity for a dampening of sound energy which is not reflected back toward the engine. As this dampening occurs, the level and intensity of sound emitted from the silencer 10 is decreased, thereby resulting in a less noticeable and more tolerable degree of noise emitted into the environment.

While the present invention has been described in conjunction with a specific embodiment, it is understood that many alternatives, modifications, and variations will be apparent to those skilled in the art in light of the foregoing description. Accordingly, this invention is intended to embrace all such alternatives, modifications and variations which fall within the spirit and scope of the appended claims.

We claim:

1. A sound reduction device for an internal combustion engine, the device comprising:

a) a body having a hollow interior portion forming a dampening chamber, the body including oppositely directed input and output sides, the interior portion including at least first and second curved surfaces opposite the input and output sides, respectively, for assisting in directing sound into a substantially non-linear channel therebetween so as to reduce the intensity of sound energy produced by an associated sound generating source; and, b) a pocket in each of the two sides, each pocket defining an air passage therein and between the input and output sides, the passages permitting air to be drawn towards the sound generating source.

2. The device of claim 1, wherein each of the two sides bound the respective passage of that side.

3. The device of claim 2, wherein the passages designate either an inlet or outlet accommodating the flow of air therethrough.

4. The device of claim 3, wherein an interior of the chamber is constructed in a substantially S-shape configuration about a longitudinal axis of the chamber.

5. The device of claim 4, wherein the chamber is connectable to an air filter enabling cleansing of air entering a vehicle engine.

6. The device of claim 5, wherein the device is constructed by rotational molding.

7. The device of claim 2, wherein each of the passages are parallel to one another.

8. The device of claim 7, wherein the passages designate either an inlet or outlet accommodating the flow of air therethrough.

9. The device of claim 8, wherein an interior of the chamber is constructed in a substantially S-shape configuration about a longitudinal axis of the chamber.

10. The device of claim 9, wherein the chamber is connectable to an air filter enabling cleansing of air entering a vehicle engine.

11. The device of claim 10, wherein the device is constructed by rotational molding.

12. The device of claim 2, wherein the passages are substantially tubular portions formed as part of the two sides.

13. The device of claim 12, wherein the passages designate either an inlet or outlet accommodating the flow of air therethrough.

14. The device of claim 13, wherein an interior of the chamber is constructed in a substantially S-shape configuration about a longitudinal axis of the chamber.

15. The device of claim 14, wherein the chamber is connectable to an air filter enabling cleansing of air entering a vehicle engine.

16. The device of claim 15, wherein the device is constructed by rotational molding.

17. The device of claim 1, wherein the two sides bound their respective passage, the passages are substantially tubular and parallel to one another.

18. The device of claim 17, wherein the passages designate either an inlet or outlet accommodating the flow of air therethrough.

19. The device of claim 18, wherein an interior of the chamber is constructed in a substantially S-shape configuration about a longitudinal axis of the chamber.

20. The device of claim 19, wherein the chamber is connectable to an air filter enabling cleansing of air entering a vehicle engine.

21. The device of claim 20, wherein the device is constructed by rotational molding.

22. The device of claim 1, wherein the device is constructed of composite material through a rotational molding process.

23. An air intake silencer comprising:

(a) a generally cylindrical body having top, bottom, and side surfaces;

(b) first and second pockets formed respectively in the top and bottom surfaces;

(c) an inlet tube formed in one of the pockets;

(d) an outlet tube formed in the other of said pockets;

(e) the inlet and outlet tubes having adjacent end portions formed within the body; and, (f) an S-shaped air path provided between the adjacent end portions of the inlet and outlet tubes.

24. The device of claim 23, wherein the device is constructed by rotational molding.

25. The device of claim 23, wherein the device is constructed of composite material through a rotational molding process.

26. A sound reduction device for an internal combustion engine, the device comprising:

a) a dampening chamber having an interior constructed in a substantially S-shape configuration about a longitudinal axis thereof and at least three sides, two of the three sides having at least one concave portion thereon; and, b) a pocket in each of the two sides and within which an air passage is located, each of the two sides bounding the respective passage of that side, each of the passages designating either an inlet or outlet accommodating the flow of air therethrough.

27. A sound reduction device for an internal combustion engine, the device comprising:

a) a dampening chamber having an interior constructed in a substantially S-shape configuration about a longitudinal axis thereof and at least three sides, two of the three sides having at least one concave portion thereon; and, b) a pocket in each of the two sides and within which an air passage is located, each of the two sides bounding the respective passage of that side, each of the passages designating either an inlet or outlet accommodating the flow of air therethrough, the chamber being connectable to an air filter enabling cleansing of air entering a vehicle engine.

28. A sound reduction device for an internal combustion engine, the device comprising:

a) a dampening chamber constructed by rotational molding and having an interior constructed in a substantially S-shape configuration about a longitudinal axis thereof and at least three sides, two of the three sides having at least one concave portion thereon; and, b) a pocket in each of the two sides and within which an air passage is located, each of the two sides bounding the respective passage of that side, each of the passages designating either an inlet or outlet accommodating the flow of air therethrough, the chamber being connectable to an air filter enabling cleansing of air entering a vehicle engine.

29. A sound reduction device for an internal combustion engine, the device comprising:

a) a dampening chamber having at least three sides, two of the three sides having at least one concave portion thereon; and, b) a pocket in each of the two sides and within which an air passage is located, each of the passages being parallel to one another and each of the two sides bounding the respective passage of that side.

30. A sound reduction device for an internal combustion engine, the device comprising:

a) a dampening chamber having at least three sides, two of the three sides having at least one concave portion thereon; and, b) a pocket in each of the two sides and within which an air passage is located, each of the passages being parallel to one another and designating either an inlet or outlet accommodating the flow of air therethrough, and each of the two sides bounding the respective passage of that side.

31. A sound reduction device for an internal combustion engine, the device comprising:

a) a dampening chamber having an interior constructed in a substantially S-shape configuration about a longitudinal axis thereof, and at least three sides, two of the three sides having at least one concave portion thereon; and, b) a pocket in each of the two sides and within which an air passage is located, each of the passages being parallel to one another and designating either an inlet or outlet accommodating the flow of air therethrough, and each of the two sides bounding the respective passage of that side.

32. A sound reduction device for an internal combustion engine, the device comprising:

a) a dampening chamber having an interior constructed in a substantially S-shape configuration about a longitudinal axis thereof, and at least three sides, two of the three sides having at least one concave portion thereon; and, b) a pocket in each of the two sides and within which an air passage is located, each of the passages being parallel to one another and designating either an inlet or outlet accommodating the flow of air therethrough, and each of the two sides bounding the respective passage of that side, the chamber being connectable to an air filter enabling cleansing of air entering a vehicle engine.

33. A sound reduction device for an internal combustion engine, the device comprising:

a) a dampening chamber constructed by rotational molding and having an interior constructed in a substantially S-shape configuration about a longitudinal axis thereof, and at least three sides, two of the three sides having at least one concave portion thereon; and, b) a pocket in each of the two sides and within which an air passage is located, each of the passages being parallel to one another and designating either an inlet or outlet accommodating the flow of air therethrough, and each of the two sides bounding the respective passage of that side, the chamber being connectable to an air filter enabling cleansing of air entering a vehicle engine.

34. A sound reduction device for an internal combustion engine, the device comprising:

a) a dampening chamber having an interior constructed in a substantially S-shape configuration about a longitudinal axis thereof, and at least three sides, two of the three sides having at least one concave portion thereon; and, b) a pocket in each of the two sides and within which an air passage is located, the passages being formed as substantially tubular portions in each of the two sides and designating either an inlet or outlet accommodating the flow of air therethrough and each of the two sides bounding the respective passage of that side.

35. A sound reduction device for an internal combustion engine, the device comprising:

a) a dampening chamber having at least three sides, two of the three sides having at least one concave portion thereon; and, b) a pocket in each of the two sides and within which an air passage is located, each of the two sides bounding their respective passage, the passages being substantially tubular in shape and parallel to one another.

36. A sound reduction device for an internal combustion engine, the device comprising:

a) a dampening chamber having at least three sides, two of the three sides having at least one concave portion thereon; and, b) a pocket in each of the two sides and within which an air passage is located, each of the two sides bounding their respective passage, the passages being substantially tubular in shape, parallel to one another and designating either an inlet or outlet accommodating the flow of air therethrough.

37. A sound reduction device for an internal combustion engine, the device comprising:

a) a dampening chamber having an interior of the chamber constructed in a substantially S-shape configuration about a longitudinal axis thereof, and at least three sides, two of the three sides having at least one concave portion thereon; and, b) a pocket in each of the two sides and within which an air passage is located, each of the two sides bounding their respective passage, the passages being substantially tubular in shape, parallel to one another and designating either an inlet or outlet accommodating the flow of air therethrough.

38. A sound reduction device for an internal combustion engine, the device comprising:

a) a dampening chamber having an interior of the chamber constructed in a substantially S-shape configuration about a longitudinal axis thereof, and at least three sides, two of the three sides having at least one concave portion thereon; and, b) a pocket in each of the two sides and within which an air passage is located, each of the two sides bounding their respective passage, the passages being substantially tubular in shape, parallel to one another and designating either an inlet or outlet accommodating the flow of air therethrough, the chamber being connectable to an air filter enabling cleansing of air entering a vehicle engine.

39. A sound reduction device for an internal combustion engine, the device comprising:

a) a dampening chamber constructed by rotational molding and having an interior constructed in a substantially S-shape configuration about a longitudinal axis thereof, and at least three sides, two of the three sides having at least one concave portion thereon; and, b) a pocket in each of the two sides and within which an air passage is located, each of the two sides bounding their respective passage, the passages being substantially tubular in shape, parallel to one another and designating either an inlet or outlet accommodating the flow of air therethrough, the chamber being connectable to an air filter enabling cleansing of air entering a vehicle engine.

* * * * *